US008695950B2

(12) United States Patent
Takesue

(10) Patent No.: US 8,695,950 B2
(45) Date of Patent: Apr. 15, 2014

(54) AUTO CHOKE APPARATUS

(75) Inventor: Yuji Takesue, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 323 days.

(21) Appl. No.: 13/290,220

(22) Filed: Nov. 7, 2011

(65) Prior Publication Data

US 2012/0119394 A1 May 17, 2012

(30) Foreign Application Priority Data

Nov. 16, 2010 (JP) ..... 2010-256033

(51) Int. Cl.
*F02M 1/10* (2006.01)

(52) U.S. Cl.
USPC ..... 261/39.3; 261/52

(58) Field of Classification Search
USPC ..... 261/39.1, 39.3, 39.4, 52; 123/179.18, 123/376, 396, 400, 403
See application file for complete search history.

(56) References Cited

U.S. PATENT DOCUMENTS

| | | | | |
|---|---|---|---|---|
| 1,996,245 | A * | 4/1935 | Hunt | 261/39.3 |
| 2,995,348 | A * | 8/1961 | Eberhardt | 261/39.3 |
| 3,529,585 | A * | 9/1970 | Stoltman | 261/39.3 |
| 3,837,628 | A * | 9/1974 | Bartholomew | 261/39.3 |
| 3,947,531 | A * | 3/1976 | Branigin | 261/39.3 |
| 4,137,283 | A * | 1/1979 | Couderc | 261/39.3 |
| 4,465,640 | A * | 8/1984 | Dougherty | 261/39.3 |
| 5,069,180 | A | 12/1991 | Schmidt et al. | |
| 5,176,855 | A * | 1/1993 | Jones | 261/39.3 |
| 6,990,969 | B2 * | 1/2006 | Roth et al. | 123/676 |
| 7,144,000 | B2 * | 12/2006 | Roth et al. | 261/39.3 |
| 7,331,326 | B2 * | 2/2008 | Arai et al. | 123/361 |
| 7,628,387 | B1 * | 12/2009 | Clouse et al. | 261/39.1 |
| 2005/0194701 | A1 * | 9/2005 | Moriyama et al. | 261/39.4 |

FOREIGN PATENT DOCUMENTS

| | | | | |
|---|---|---|---|---|
| JP | 04-262043 | | 9/1992 | |
| JP | 4-262043 | | 9/1992 | |
| JP | 6-50211 | A * | 2/1994 | 261/39.3 |
| JP | 08-291764 | | 5/1996 | |

* cited by examiner

*Primary Examiner* — Richard L Chiesa
(74) *Attorney, Agent, or Firm* — Smith, Gambrell & Russell, LLP.

(57) ABSTRACT

In an auto choke apparatus, a throttle valve and a choke valve are provided in a carburetor. A bimetal is provided near a muffler to bring the choke valve back in an opening direction after warm-up is completed. A bimetal lever has a mounting hole to which one end of a choke rod is secured. A choke lever has a mounting hole having a long hole shape to which the other end of the choke rod is secured. By forming the mounting hole of the choke lever in a long hole shape, the choke lever can be moved with the bimetal lever being stopped so that a throttle lever and the choke lever can be caused to work together without being restricted by the bimetal.

2 Claims, 5 Drawing Sheets

AUTO CHOKE APPARATUS

CROSS-REFERENCE TO RELATED APPLICATIONS

The present application claims priority from Japanese Patent Application No. 2010-256033 filed on Nov. 16, 2010, the entire contents of which are hereby incorporated by reference.

BACKGROUND OF THE INVENTION

1. Field of the Invention

The present invention relates to an auto choke apparatus that drives a choke valve of an intake system by using a bimetal.

2. Description of the Related Art

A choke valve is provided in a carburetor that is part of an intake system of an engine to improve starting performance. By closing the choke valve, an air fuel mixture can be made denser with a reduced amount of intake air so that the engine can be started smoothly. If the air fuel mixture is temporarily made denser by operating the choke valve in this manner, it is necessary to moving the choke valve back in the opening direction after the engine is started to maintain a good driving state of the engine by making the air fuel mixture thinner. To automate such a choke valve operation, an auto choke apparatus that operates the choke value by a bimetal is proposed (see, for example, Japanese Patent Application Laid-Open (JP-A) No. 4-262043). The auto choke apparatus drives the choke valve by a bimetal disposed near a muffler and the choke valve is moved back in the opening direction according to a rising muffler temperature after the engine is started.

In addition to the choke valve, a throttle valve to mainly adjust the amount of intake air is provided in the carburetor that is part of the intake system. Since the two valves are provided in the intake system for adjusting the amount of intake air, it is necessary to cause the choke valve and throttle valve to work together to adjust the density of the air fuel mixture appropriately. For example, if, immediately after the engine is started when the choke valve is operating in the closing direction, the throttle valve is operated in the closing direction, it is necessary to operate the choke valve in the opening direction in conjunction with the throttle valve so that the air fuel mixture is not made excessively dense. In an auto choke apparatus according to JP-A No. 4-262043, the throttle valve and the choke valve are caused to work together by transferring a rotational movement operation of a throttle lever fixed to the throttle valve to a choke lever fixed to the choke valve.

However, a bimetal is coupled to the choke valve and thus, when the throttle valve and the choke valve are caused to work together, it is important to configure the throttle valve and the choke valve in such a way that the operation of the throttle valve is not hindered by the bimetal. In the auto choke apparatus according to JP-A No. 4-262043, therefore, an arm member is provided freely rotatably with respect to the choke valve, and the choke valve and the bimetal are coupled via the arm member. Further, a choke lever is fixed to the choke valve. Thus, if the arm member is rotated to overtake the choke lever, the choke lever and the arm member rotate simultaneously. Accordingly, in a stage before the bimetal operates according to a rising muffler temperature, the choke lever can be moved rotationally without being hindered by the arm member (bimetal) so that the throttle valve and the choke valve can be caused to work together.

However, providing the arm member, in addition to the choke lever, for the choke valve leads to an increase in the number of components of an auto choke apparatus and also to a higher cost of the auto choke apparatus.

Moreover, placing the arm member between the choke valve and the bimetal leads to a higher cost of the bimetal. That is, since large allowance of the arm member is set between the choke valve and the bimetal, it is necessary to move the bimetal by a large operating angle to transmit the rotation operation of the bimetal to the choke valve. Thus, using the bimetal of a large operating angle leads to a higher cost of an auto choke apparatus.

SUMMARY OF THE INVENTION

The present invention aims to provide an auto choke apparatus with a lower cost.

An aspect of the present invention provides an auto choke apparatus that drives a choke valve of an intake system by using a bimetal. A rod member is provided between a bimetal lever fixed to the bimetal and a choke lever fixed to the choke valve. One end of the rod member is secured to a first mounting hole of the bimetal lever, and the other end of the rod member is secured to a second mounting hole of the choke lever. The choke lever is rotationally moved within a predetermined range of rotational movement without causing the bimetal lever to work together by forming at least one of the first mounting hole and the second mounting hole as a long hole.

Preferably, the auto choke apparatus according to the present invention should include a throttle lever including a cam surface that comes into contact with the choke lever and is fixed to a throttle valve of the intake system. In the predetermined range of rotational movement, the choke lever rotationally moves by being pushed by the cam surface of the throttle lever.

Preferably, the second mounting hole of the auto choke apparatus according to the present invention should be formed in a long hole shape.

Preferably, the second mounting hole of the auto choke apparatus according to the present invention should be formed in a long hole shape extending in a vertical direction with respect to a rotational direction of the choke lever.

According to the present invention, since the one end of the rod member is secured to the first mounting hole of the bimetal lever, the other end of the rod member is secured to the second mounting hole of the choke lever, and at least one of the first mounting hole and the second mounting hole is formed in a long hole shape, the choke lever can rotationally be moved with a stop position of the bimetal lever being maintained. Accordingly, a throttle lever and the choke lever can be caused to work together without being restricted by the bimetal. Such a coordinated operation of the throttle lever and the choke lever can be achieved with a simple structure in which at least one of the first mounting hole and the second mounting hole is formed in a long hole shape, whereby the auto choke apparatus can be achieved with a lower cost.

DETAILED DESCRIPTION OF THE PREFERRED EMBODIMENTS

Figure 1:
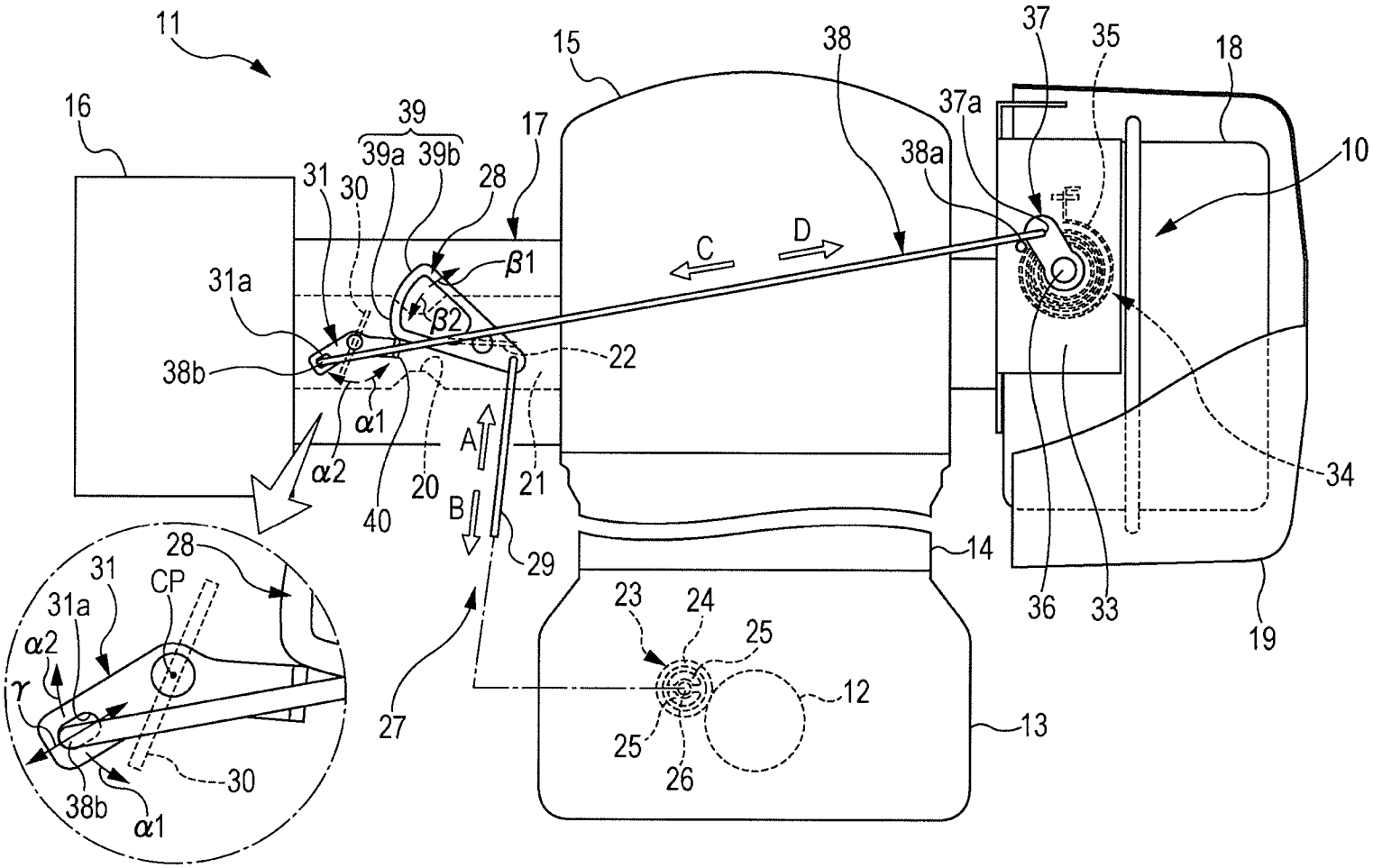
FIG. 1 is a side view schematically showing an engine including an auto choke apparatus according to an embodiment of the present invention.
Figure 2:
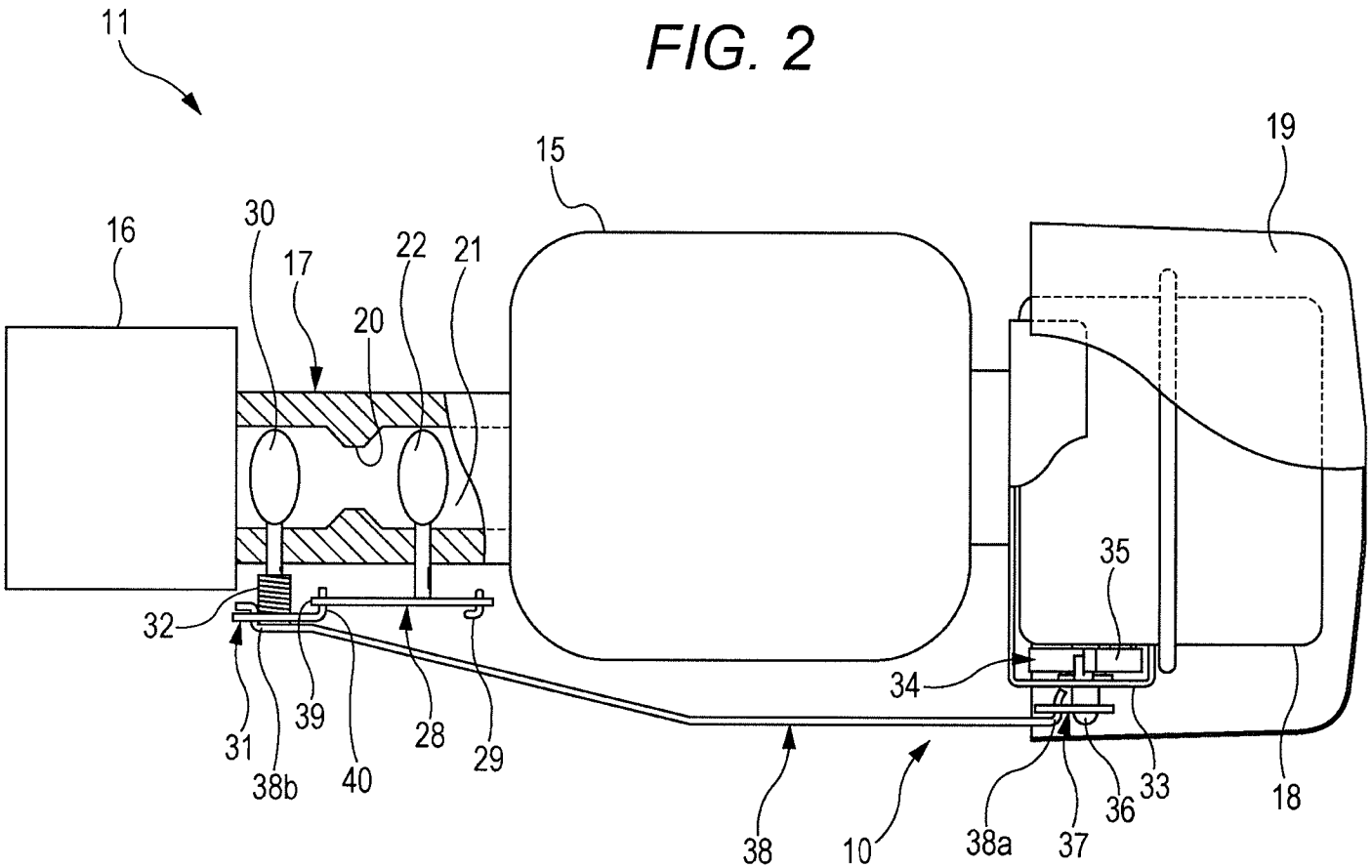
FIG. 2 is a plan view schematically showing the engine in FIG. 1 viewed from above.

Embodiments of the present invention will be described below with reference to the drawings. FIG. 1 is a side view schematically showing an engine 11 including an auto choke apparatus 10 according to an embodiment of the present invention. FIG. 2 is a plan view schematically showing the engine 11 viewed from above in FIG. 1. As shown in FIGS. 1 and 2, the engine 11 includes a crankcase 13 to accommodate a crankshaft 12. A cylinder 14 is attached to an upper end of the crankcase 13, and a cylinder head 15 is attached to the upper end of the cylinder 14. An air cleaner 16 and a carburetor 17 that are part of an intake system are connected to an intake port (not shown) of the cylinder head 15. Further, a muffler 18 constituting an exhaust system is connected to an unillustrated exhaust port of the cylinder head 15. A muffler cover 19 is mounted on the muffler 18.

The carburetor 17 has formed therein an intake channel 21 including a venturi unit 20 and a throttle valve 22 is provided at a downstream side of the venturi unit 20. A governor mechanism 23 is accommodated in the crankcase 13 to control the throttle valve 22. The governor mechanism 23 has a governor case 24 driven to rotate by the crankshaft 12. The governor case 24 is provided with a weight 25 tilted by a centrifugal force and a push rod 26 pushed out by the tilting operation of the weight 25 therein. A link mechanism 27 is provided between the governor mechanism 23 and the throttle valve 22 to transmit the operation of the governor mechanism 23 to the throttle valve 22. The link mechanism 27 includes a throttle lever 28 fixed to the throttle valve 22 and a throttle rod 29 provided between the throttle lever 28 and the push rod 26.

If an engine speed is increased to push out the push rod 26, the throttle rod 29 operates in an arrow A direction against a unillustrated governor spring to rotate the throttle lever 28 in a closing direction of the throttle valve 22. On the other hand, if the engine speed is decreased so that a push-out force of the push rod 26 decreases, the throttle rod 29 operates in an arrow B direction by an elastic force of the governor spring to rotate the throttle lever 28 in an opening direction of the throttle valve 22. Thus, by providing the governor mechanism 23 operating according to the engine speed, the throttle lever 28 can be controlled so that the engine speed can be maintained constant.

A choke valve 30 is provided at an upstream side of the venturi unit 20 of the carburetor 17. To control the choke valve 30, a return spring 32 energizing a choke lever 31 fixed to the choke valve 30 in an arrow $\alpha$1 direction is attached to the choke lever 31. In addition, a bimetal 34 is mounted on a heat shield plate 33 covering part of the muffler 18 to rotationally move the choke lever 31 in an arrow $\alpha$2 direction. The bimetal 34 is a spiral bimetal formed by winding a long metal plate 35. A bimetal lever 37 is mounted on an end of the metal plate 35, which is positioned in a center position of the bimetal 34, via a rotation axis 36. The metal plate 35 which is part the bimetal 34 is formed by bonding two metal materials having different coefficients of thermal expansion and can rotationally move the bimetal lever 37 according to the temperature of the bimetal 34.

To transmit a rotational movement operation of the bimetal lever 37 to the choke lever 31, the bimetal lever 37 and the choke lever 31 are coupled via a choke rod (rod member) 38. The bimetal lever 37 has formed therein a mounting hole (first mounting hole) 37*a*, and one end 38*a* of the choke rod 38 is secured to the mounting hole 37*a*. The choke lever 31 has formed therein amounting hole (second mounting hole) 31*a*, and the other end 38*b* of the choke rod 38 is secured to the mounting hole 31*a*. As shown in an enlarged view in FIG. 1, the mounting hole 31*a* of the choke lever 31 is formed in a long hole shape extending in a vertical direction $\gamma$ with respect to rotational movement directions $\alpha$1 and $\alpha$2 of the choke lever 31. In other words, the mounting hole 31*a* of the choke lever 31 is formed in a long hole shape extending in a radiating direction (radial direction) $\gamma$ from a rotational movement center CP of the choke lever 31. By forming the mounting hole 31*a* in a long hole shape in this manner, the choke lever 31 and the choke rod 38 are coupled with a predetermined amount of allowance.

In the case the engine is started when the temperature of the muffler 18 is low, the temperature of the bimetal 34 is also low. Thus, the choke rod 38 is pushed out in an arrow C direction by the bimetal 34. In this state, the choke lever 31 is energized in the arrow $\alpha$1 direction by the return spring 32, and the choke valve 30 operates so as to close the intake channel 21. Thus, in a choke operating state in which the choke valve 30 operates toward the closing side, the throttle valve 22 and the choke valve 30 work together so that the amount of intake air is adjusted by both the throttle valve 22 and the choke valve 30. On the other hand, after engine warm-up at which the temperature of the muffler 18 rises, the temperature of the bimetal 34 also rises, and thus, the choke rod 38 is drawn in an arrow D direction by the bimetal 34. In this state, since the choke lever 31 is rotationally moved in the arrow $\alpha$2 direction by the choke rod 38, the choke valve 30 operates so as to open the intake channel 21. Thus, in a choke released state in which the choke valve 30 operates toward the opening side, since the choke valve 30 is fixed in a fully open state, the amount of intake air is adjusted by the throttle valve 22.

To cause the throttle valve 22 and the choke valve 30 to work together in the choke operating state as described above, a cam surface 39 is formed on the throttle lever 28, and a projecting piece 40 that comes into contact with the cam surface 39 is formed on the choke lever 31. Accordingly, while the choke lever 31 rotationally moves in the $\alpha$1 direction when the throttle lever 28 is rotationally moved in an arrow $\beta$1 direction, the choke lever 31 rotationally moves in the $\alpha$2 direction when the throttle lever 28 is rotationally moved in an arrow $\beta$2 direction. That is, while the choke valve 30 is operated in the opening direction if the throttle valve 22 is operated in the closing direction, the choke valve 30 is operated in the closing direction if the throttle valve 22 is operated in the opening direction. Since the choke lever 31 is energized by the return spring 32, the projecting piece 40 of the choke lever 31 is always pressed against the cam surface 39 of the throttle lever 28 in the choke operating state.

The cam surface 39 of the throttle lever 28 includes a first cam surface 39*a* that is a former portion thereof and a second cam surface 39*b* that is a latter portion thereof. The first cam surface 39*a* is formed gradually away from the rotational movement center of the throttle lever 28, and the second cam surface 39*b* is formed on an arc surface around the rotational movement center of the throttle lever 28. Accordingly, the choke lever 31 rotationally moves in conjunction with the throttle lever 28 in a process in which the first cam surface 39*a* of the throttle lever 28 comes into contact with the projecting piece 40 of the choke lever 31. On the other hand, the choke lever 31 holds the rotational movement position thereof in the process in which the second cam surface 39*b* of the throttle lever 28 comes into contact with the projecting piece 40 of the choke lever 31.

Figure 3A:
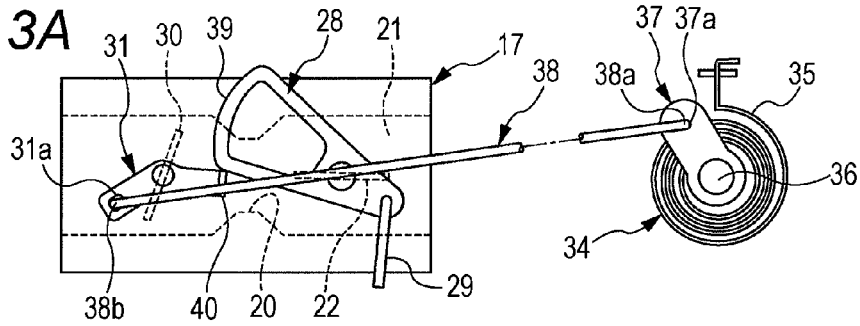
FIGS. 3A to 3D are explanatory views showing operation processes of a throttle valve and a choke valve.
Figure 3B:
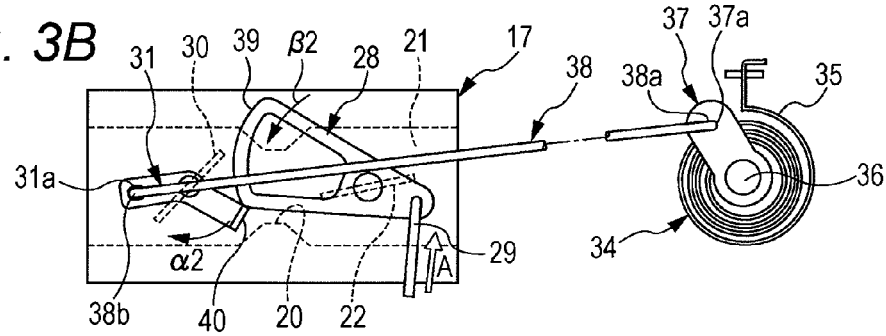
Figure 3C:
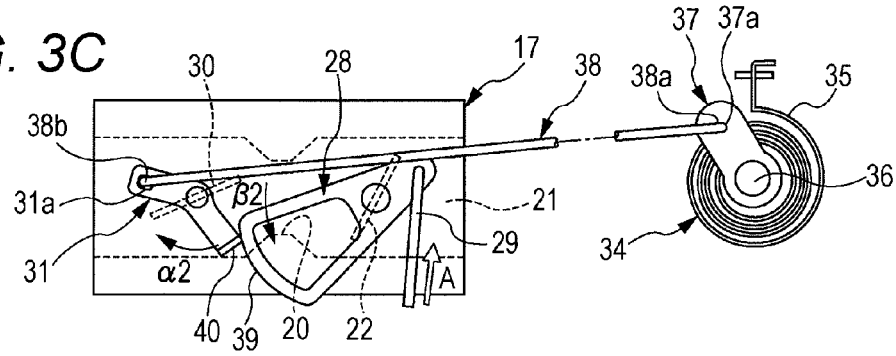
Figure 3D:
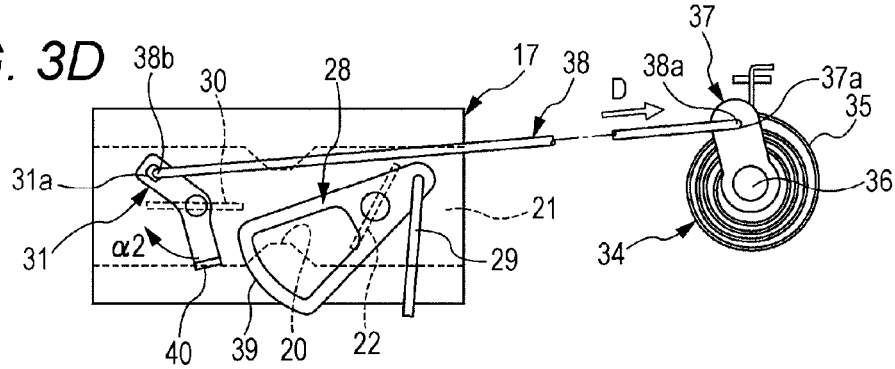

Next, the operation of the throttle valve 22 and the choke valve 30 will be described. FIGS. 3A to 3D are explanatory views showing operation processes of the throttle valve 22 and the choke valve 30. FIGS. 3A to 3C show a choke operating state, and FIG. 3D shows a choke released state. As shown in FIG. 3A, when the engine is started, the throttle valve 22 is controlled to a fully open state, accompanying the stop of the governor mechanism 23. Due to a dropped temperature of the bimetal 34, the choke valve 30 is controlled to a fully closed position. Thus, when the engine is started, the choke valve 30 is closed, and therefore, the engine 11 can be started smoothly by making an air fuel mixture denser.

Subsequently, when the engine 11 is started, as shown in FIG. 3B followed by FIG. 3C, the governor mechanism 23 operates according to the increasing engine speed to drive the throttle rod 29 in the arrow A direction. Accordingly, the throttle lever 28 rotationally moves in the arrow β2 direction, and the choke lever 31 rotationally moves in the arrow α2 direction by being pushed by the throttle lever 28. Thus, by causing the throttle lever 28 and the choke lever 31 to work together, the air fuel mixture can be adjusted appropriately. That is, when the throttle valve 22 is operated in the closing direction to curb an increase in the engine speed, the choke valve 30 is operated in the opening direction so that the air fuel mixture is not made excessively dense.

As described above, while it is necessary to cause the throttle lever 28 and the choke lever 31 to work together in a choke operating state, due to the long hole shape of the mounting hole 31*a* of the choke lever 31, the choke lever 31 can rotationally be moved with the stop position of the bimetal lever 37 being maintained as shown in FIGS. 3A to 3C. Accordingly, the throttle lever 28 and the choke lever 31 can be caused to work together smoothly in the choke operating state without the movement of the choke lever 31 being restricted by the bimetal lever 37 fixed to the position shown in FIG. 3A.

Figure 4:
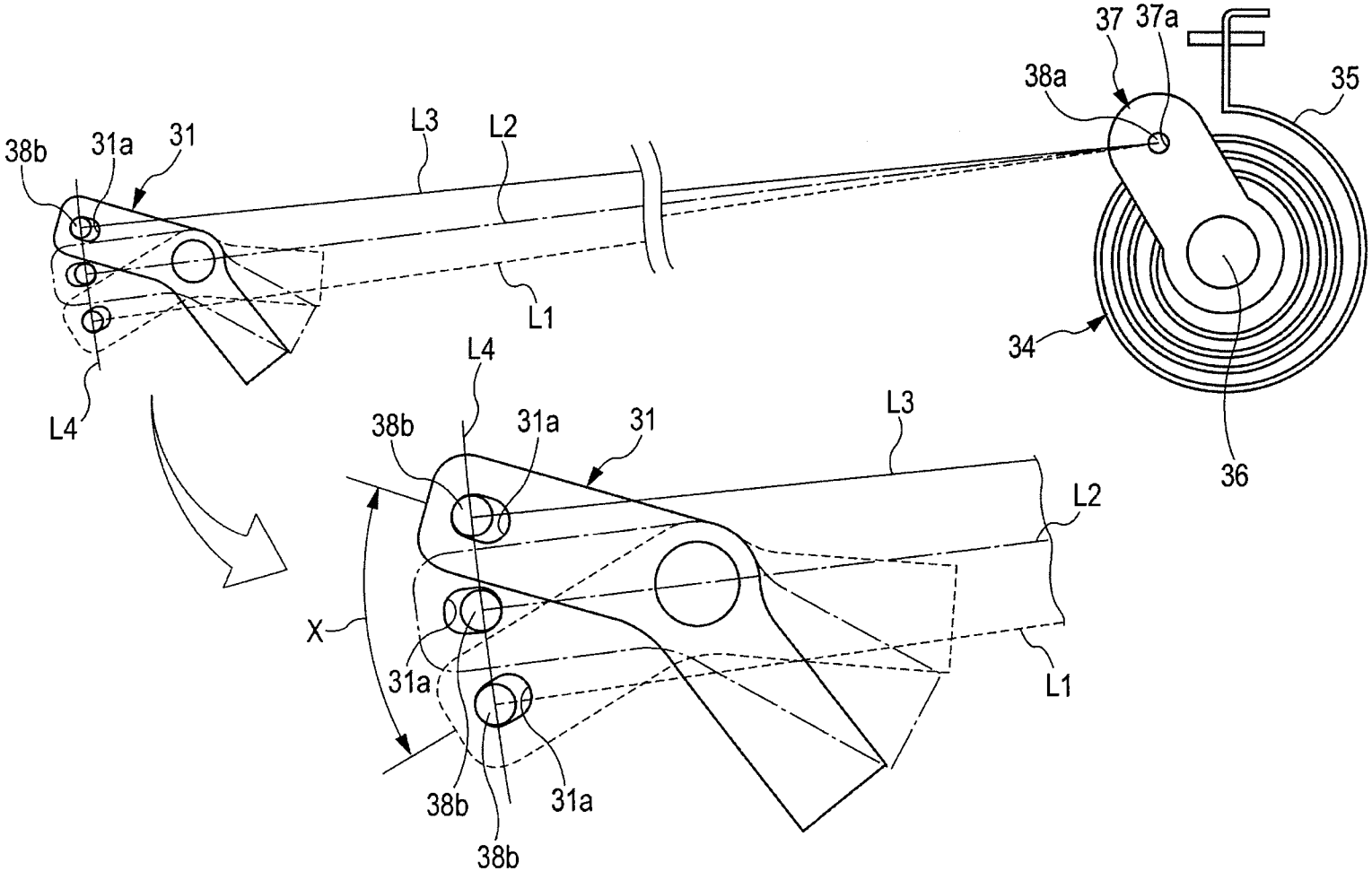
FIG. 4 is an explanatory view showing an operating state of a bimetal lever and a choke lever in a choke operating state.

FIG. 4 is an explanatory view showing an operating state of the bimetal lever 37 and the choke lever 31 in the choke operating state. In FIG. 4, the rotational movement position of the bimetal lever 37 shown in FIG. 3A is shown by using a broken line, the rotational movement position of the bimetal lever 37 shown in FIG. 3B is shown by using an alternate long and short dash line, and the rotational movement position of the bimetal lever 37 shown in FIG. 3C is shown by using a solid line. Lines L1 to L3 represent center lines of the choke rod 38 in each rotational movement position and a line L4 represents a trajectory of the other end 38*b* of the choke rod 38.

As shown in FIG. 4, since the mounting hole 31*a* of the choke lever 31 is formed in a long hole shape and thus, the other end 38*b* of the choke rod 38 can be slid inside the mounting hole 31*a*. Accordingly, the choke rod 38 can be swung using the mounting hole 37*a* of the bimetal lever 37 as a fulcrum, and therefore, the choke lever 31 can be caused to move rotationally within a predetermined range X of rotational movement without causing the bimetal lever 37 and the choke lever 31 to work together. The predetermined range X of rotational movement is a range of rotational movement of the choke lever 31 in the choke operating state and a range of rotational movement of the choke lever 31 rotationally moved by being pushed by the cam surface 39 of the throttle lever 28.

As shown in FIG. 3D, when the warm-up operation of the engine 11 is completed, the temperature of the bimetal 34 has risen, and thus, the choke rod 38 is drawn in the arrow D direction by the bimetal 34. Accordingly, the choke lever 31 is rotationally moved in the arrow α2 direction away from the throttle lever 28, and the choke valve 30 is maintained in a fully open position. Since the choke valve 30 is fixed to the fully open position in the choke released state, the amount of intake air is adjusted by the throttle valve 22.

As described above, since the mounting hole 31*a* of the choke lever 31 is formed in a long hole shape, the throttle lever 28 and the choke lever 31 can be caused to work together in the choke operating state. Accordingly, an arm member (choke arm) of a conventional auto choke apparatus like a choke rod arm 82 described in JP-A No. 4-262043 can be eliminated, whereby the number of components of the auto choke apparatus 10 can be reduced. Therefore, component costs and assembly costs of the auto choke apparatus 10 can be reduced.

Moreover, since the mounting hole 31*a* of the choke lever 31 is formed in a long hole shape extending in the vertical direction γ with respect to the rotational movement directions α1 and α2 of the choke lever 31, the operating angle required of the bimetal 34 can be reduced. Specifically, a conventional auto choke apparatus (see, for example, JP-A No. 4-262043) has a structure in which an arm member is provided freely rotatably to the choke valve 30, and the bimetal lever 37 is coupled to an arm member. Further, in the conventional auto choke apparatus the choke lever 31 and the arm member are caused to rotate simultaneously when the arm member is rotationally moved so as to overtake the choke lever 31 by exceeding the range X of rotational movement shown in FIG. 4. Therefore, to switch from the choke operating state to the choke released state by rotationally moving the choke lever 31, it is necessary to rotationally move the bimetal lever 37 further by an amount corresponding to the range X of rotational movement.

In the auto choke apparatus 10 according to the present invention, by contrast, no arm member provided freely rotatably is used. Thus, a rotational movement angle of the bimetal lever 37 necessary for switching from the choke operating state to the choke released state can be set smaller by a rotational movement angle corresponding to the range X of rotational movement. Moreover, the mounting hole 31*a* is formed in a long hole shape extending perpendicularly to the rotational movement directions α1 and α2 of the choke lever 31. Thus, when the choke lever 31 is rotationally moved within the range X of rotational movement, as shown in FIG. 4, the other end 38*b* of the choke rod 38 reciprocates inside the mounting hole 31*a*. Therefore, the major axis of the mounting hole 31*a* in a long hole shape can be designed shorter so that the amount of allowance between the mounting hole 31*a* and the other end 38*b* can be set less. Accordingly, the rotational movement operation of the bimetal lever 37 can be transmitted to the choke lever 31 efficiently. As a result, the rotational movement angle of the bimetal lever 37 necessary for switching from the choke operating state to the choke released state can be made smaller.

Since the rotational movement angle of the bimetal lever 37 can be reduced, the operating angle required of the bimetal can be reduced. Accordingly, if a bimetal having an operating angle equivalent to a conventional one is used, a margin regarding a mounting angle of the bimetal 34 becomes larger so that the bimetal 34 can be assembled easily. Moreover, since the operating angle required of the bimetal 34 becomes smaller, a cost reduction of the bimetal 34 can be achieved.

Figure 5A:
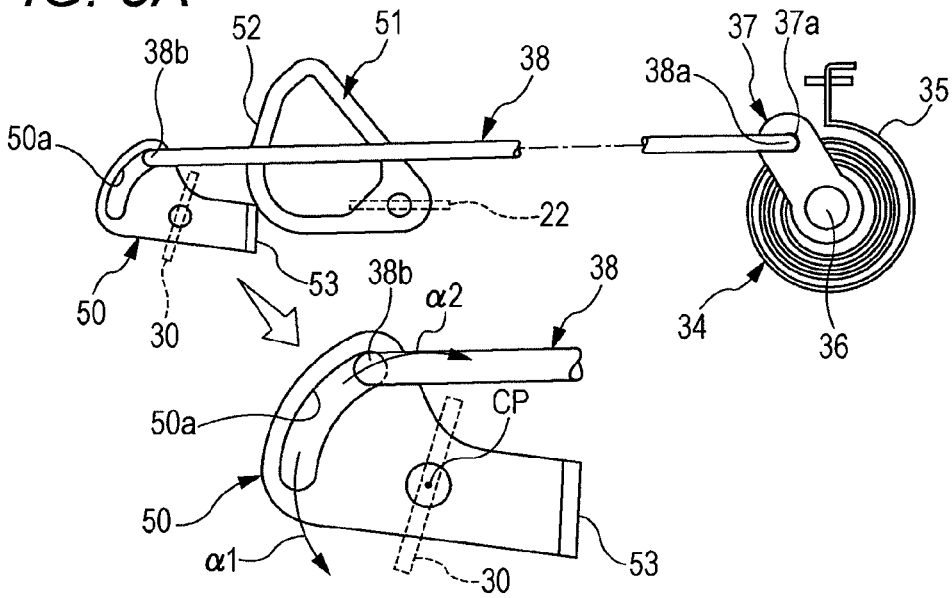
FIGS. 5A to 5C are explanatory views showing part of the auto choke apparatus according to another embodiment of the present invention.
Figure 5B:
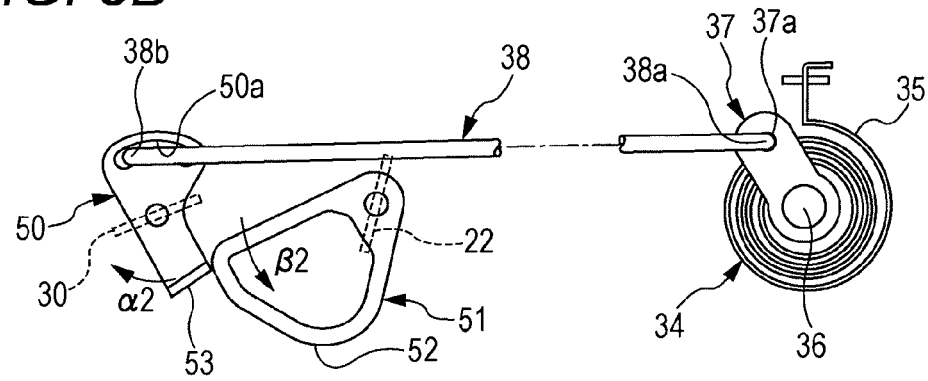
Figure 5C:
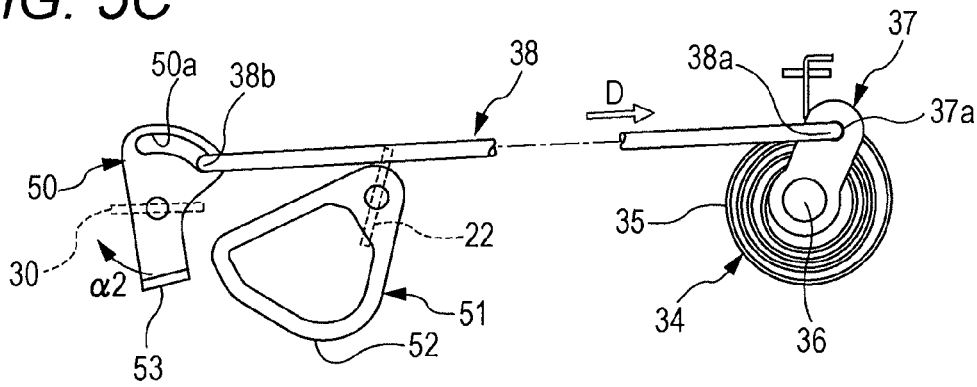

In the above description, the mounting hole 31*a* of the choke lever 31 is formed in a long hole shape extending in the vertical direction γ with respect to the rotational movement directions α1 and α2. However, but the long hole shape is not limited to this, and the mounting hole 31*a* may also be formed in another a long hole shape. FIGS. 5A to 5C are explanatory views showing part of an auto choke apparatus according to another embodiment of the present embodiment. FIGS. 5A to 5C show operation processes of the throttle valve 22 and the choke valve 30. FIGS. 5A and 5B shows the choke operating state, and FIG. 5C shows the choke released state. In FIG. 5, same members as those shown in FIG. 3 are denoted by like reference numerals, and descriptions thereof are omitted.

As shown in FIG. 5A, a choke lever 50 is fixed to the choke valve 30 and the choke lever 50 has formed therein a mounting hole (second mounting hole) 50*a*. The other end 38*b* of the choke rod 38 is secured to the mounting hole 50*a*. As shown in an enlarged view of FIG. 5A, the mounting hole 50*a* of the choke lever 50 is formed in a long hole shape extending along the rotational movement directions α1 and α2 of the choke lever 50. In other words, the mounting hole 50*a* of the choke lever is formed in a long hole shape extending along the circumferential directions α1 and α2 around the rotational movement center CP of the choke lever 50. By forming the mounting hole 50*a* in an arc-like long hole in this manner, the choke lever 50 and the choke rod 38 are coupled with a predetermined amount of allowance. A cam surface 52 is formed on a throttle lever 51 fixed to the throttle valve 22 to cause the throttle valve 22 and the choke valve 30 to work together in the choke operating state. Further, a projecting piece 53 that comes into contact with the cam surface 52 is formed on the choke lever 50.

Thus, even if the mounting hole 50*a* is formed as a curved long hole, the other end 38*b* of the choke rot 38 can be slid inside the mounting hole 50*a*. Accordingly, as shown in FIGS. 5A and 5B, the choke lever 50 can rotationally be moved with the stop position of the bimetal lever 37 being maintained. Thus, like the auto choke apparatus 10 described above, the throttle lever 51 and the choke lever 50 can be caused to work together in the choke operating state without the movement of the choke lever 50 being restricted by the bimetal lever 37 to be fixed. Accordingly, an arm member assembled into a conventional auto choke apparatus can be eliminated so that the number of components of the auto choke apparatus can be reduced. Therefore, component costs and assembly costs of the auto choke apparatus can be reduced. As shown in FIG. 5C, since the choke rod 38 is drawn in the arrow D direction according to a rising temperature of the bimetal 34 in the choke released state, the choke lever 50 is rotationally moved in the arrow α2 direction away from the throttle lever 51, and the choke valve 30 is maintained in a fully open position.

The present invention is not limited to the above embodiments, and various modifications can be made without departing from the scope of the present invention. For example, only the mounting holes 31*a* and 50*a* of the choke levers 31 and 50 are formed in long hole shapes in the above description, but the present invention is not limited to this. Alternatively, only the mounting hole 37*a* of the bimetal lever 37 maybe formed in a long hole shape, or all of the mounting holes 31*a*, 37*a* and 50*a* may be formed in long hole shapes. The long hole shapes of the mounting holes 31*a*, 50*a* and 37*a* are not limited to the illustrated shapes and may be an elliptic shape or the like.

In the above description the governor mechanism 23 is driven by the crankshaft 12, but the present invention is not limited to this. Alternatively, The governor mechanism 23 may be operated by a depression pressure at engine manifold. Further, the throttle valve 22 is controlled by the governor mechanism 23 in the above description. However, the control method of the throttle valve 22 is not limited to the above example, and the present invention may be applied to an engine in which the throttle valve 22 is manually operated.

What is claimed is:

1. An auto choke apparatus that drives a choke valve of an intake system by using a bimetal from a state where the choke valve is operated in a closing direction to a state where the choke valve is operated in an opening direction, in conjunction with the operation of a throttle valve of the intake system in the closing direction, wherein:

a rod member is provided between a bimetal lever fixed to the bimetal and a choke lever fixed to the choke valve;

one end of the rod member is secured to a first mounting hole of the bimetal lever, and the other end of the rod member is secured to a second mounting hole of the choke lever; and the second mounting hole is formed in a long hole shape extending in a vertical direction with respect to a rotational direction of the choke lever, and the choke lever is rotationally moved within a predetermined range of rotational movement without causing the bimetal lever and the choke lever to work together.

2. The auto choke apparatus according to claim 1, further comprising:

a throttle lever including a cam surface that comes into contact with the choke lever and is fixed to the throttle valve, wherein the choke lever rotationally moves within the predetermined range of rotational movement by being pushed by the cam surface of the throttle lever.

* * * * *